US005724695A

United States Patent [19]

Galizia

[11] Patent Number: 5,724,695

[45] Date of Patent: Mar. 10, 1998

[54] FOOT BRUSH ASSEMBLY

[76] Inventor: Michael A. Galizia, 153 Sussex Ct., Roselle, Ill. 60172

[21] Appl. No.: 705,563

[22] Filed: Aug. 29, 1996

[51] Int. Cl.[6] ..... A46B 11/00

[52] U.S. Cl. ..... 15/160; 15/104.92; D32/47

[58] Field of Search ..... 4/606; 15/104.92, 15/114, 160, 161; 601/134, 136, 138, 27, 28; D28/63; D32/47

[56] References Cited

U.S. PATENT DOCUMENTS

| | | | |
|---|---|---|---|
| D. 283,847 | 5/1986 | Miller . | |
| D. 287,310 | 12/1986 | Miller . | |
| D. 287,311 | 12/1986 | Miller . | |
| 747,031 | 12/1903 | Bartoszek . | |
| 1,569,939 | 1/1926 | Sperling . | |
| 2,591,331 | 4/1952 | Baumbach . | |
| 2,852,793 | 9/1958 | Shelton . | |
| 3,074,093 | 1/1963 | McDonald | 15/161 |
| 3,093,130 | 6/1963 | Cotton . | |
| 3,543,747 | 12/1970 | Gustafson . | |
| 3,548,439 | 12/1970 | Berst . | |
| 3,939,825 | 2/1976 | Krummenacher . | |
| 3,973,286 | 8/1976 | Logan . | |
| 4,243,446 | 1/1981 | Mathey . | |
| 4,404,965 | 9/1983 | Waits et al. . | |
| 4,520,525 | 6/1985 | Yogi et al. . | |
| 4,532,668 | 8/1985 | Slonicki . | |
| 4,617,917 | 10/1986 | Miller . | |
| 4,694,831 | 9/1987 | Seltzer . | |
| 4,751,784 | 6/1988 | Petker et al. . | |
| 4,789,262 | 12/1988 | Sanchez . | |
| 5,177,829 | 1/1993 | Simpson . | |
| 5,205,071 | 4/1993 | Hergenroeder . | |
| 5,321,867 | 6/1994 | Probst . | |
| 5,371,958 | 12/1994 | Brosseau . | |

OTHER PUBLICATIONS

Advertising circular for The Footmate™ Brush (no date given).

*Primary Examiner*—Terrence Till
*Attorney, Agent, or Firm*—Olson & Hierl, Ltd.

[57] ABSTRACT

A foot brush assembly for use in the shower or the like including a base member and a loofa base pad removably strapped to the base member. The foot is rubbed against the surface of the loofa base pad and a brush thereon for massaging or cleaning the bottom of the foot. A sponge and bar of soap are disposed between the base member and loofa base pad for lathering the foot during use. A bridge member is removably secured over the top of the base member and defines a foot receiving cavity. A loofa bridge pad including a brush is removably strapped to the inner surface of the bridge member for massaging or cleaning the top and sides of the foot when the foot is received in the foot cavity.

19 Claims, 4 Drawing Sheets

FOOT BRUSH ASSEMBLY

FIELD OF THE INVENTION

This invention relates to a brush assembly and, more particularly, to an improved brush assembly for massaging and cleaning the feet.

BACKGROUND OF THE INVENTION

A body extremity such as the foot is difficult to massage and clean particularly for individuals who, because of age or other infirmity, are ambulatory or physically disabled and cannot bend or reach over sufficiently to manually massage or cleanse their feet.

While numerous foot brush assemblies have been proposed, they have met with limited success for a number of reasons including, but not limited to, their cost in terms of both purchase and manufacture, their complexity, their bulkiness, and the inability to clean the brush components of the brush assembly after use.

It would thus be desirable to provide a foot brush assembly which is economical to manufacture and purchase, simple to use, compact, and which includes brush components which are easy to clean after use. The present invention meets these needs.

SUMMARY OF THE INVENTION

The foot brush assembly of the present invention comprises a base member and a base pad disposed over the base member. The base pad includes a plurality of elastic straps which extend around the base member for removably securing the base pad to the base member. The foot is placed on and brushed against the top of the base pad to massage or clean the bottom of the foot.

A sponge including a cavity therein for receiving a bar of soap is disposed between the base member and the base pad.

A bridge member is releasably snapped over the top of the base member adjacent a front wall of the base member. The bridge member and base member define a foot receiving cavity.

A bridge pad is disposed over the inner surface of the bridge member so that when the foot is inserted into the cavity, the top of the foot can be massaged or cleaned by brushing the top of the foot against the pad. Elastic bridge pad straps are provided on the bridge pad for removably securing the bridge pad to the inner surface of the bridge member.

The base pad and the bridge pad both additionally include a brush integral therewith for enhanced massaging and cleaning action.

Both the base pad and the bridge pad are preferably made of a sponge-like loofa material which is soft for use on the skin, releases soap at a desired rate and dries rapidly after use thus resisting mildew and the growth of other micro-organisms.

The base pad and the bridge pad may advantageously be removed from the base member and the bridge member respectively for cleaning or replacement thus eliminating the growth of mildew and other micro-organisms which normally results from the repeated use of the same pad.

The foot brush assembly further includes a basin which receives the base member. The basin may be filled with water thus advantageously allowing the foot brush assembly to be used outside the shower if desired.

A cover is adapted to be fitted over the basin and the base member for storing the foot brush assembly when it is not in use. Alternatively, the cover may be filled with water and used as a foot rinse basin when the foot brush assembly is used outside the shower.

There are other advantages and features of the present invention which will be more readily apparent from the following detailed description of the preferred embodiment of the invention, the accompanying drawings, and the appended claims.

DESCRIPTION OF THE PREFERRED EMBODIMENT

Figure 1:
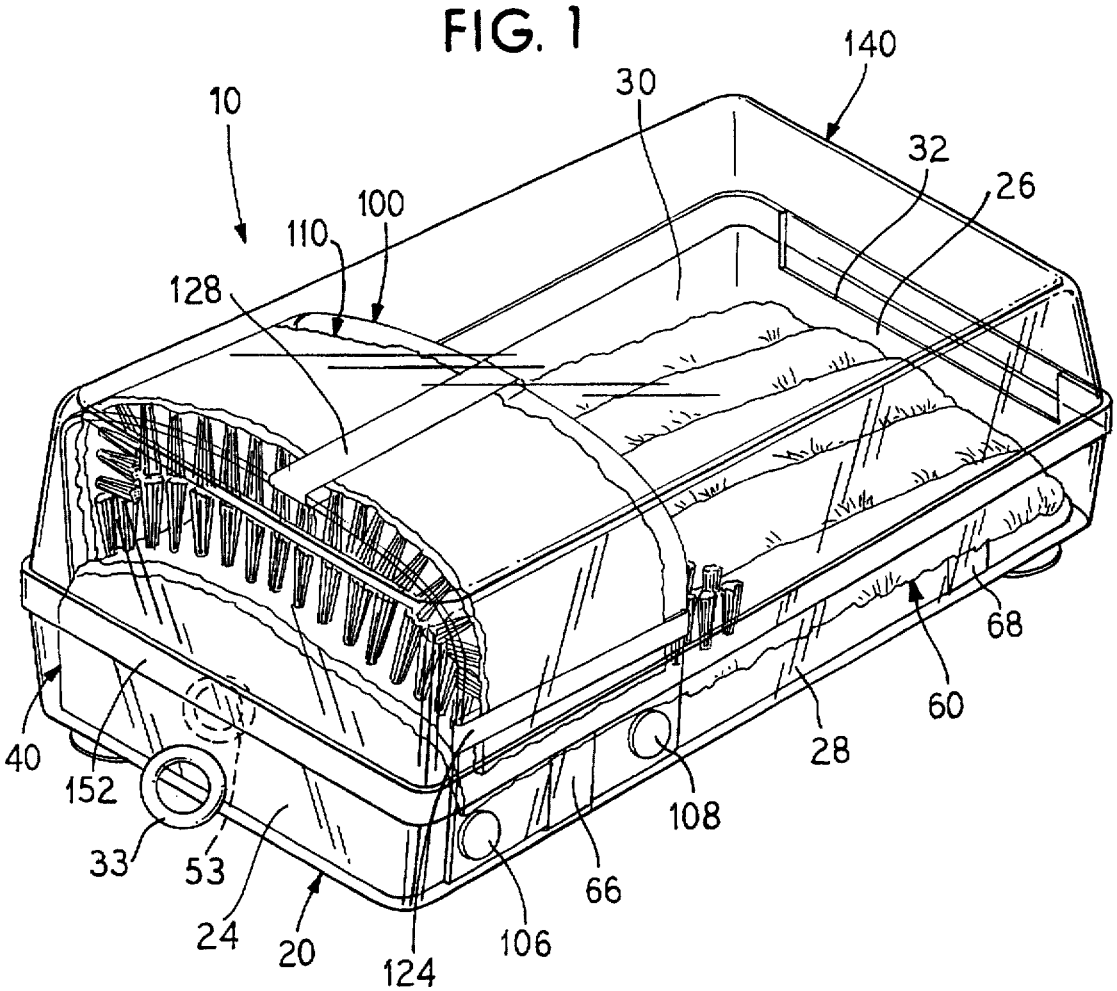
FIG. 1 is a perspective view of a foot brush assembly in accordance with the present invention.

The invention disclosed herein is, of course, susceptible of embodiment in many different forms. Shown in the drawings and described below in detail is a preferred embodiment of the invention. It is to be understood, however, that the present disclosure is an exemplification of the principles of the invention and does not limit the invention to the illustrated embodiment.

The precise shapes and sizes of the components described herein are not essential to the invention unless otherwise indicated.

For ease of description, the foot brush assembly of the present invention will be described in its normal horizontal position on the floor of a shower or the like and terms such as upper, lower, horizontal, vertical, etc., will be used with reference to this position. It will be understood, however, that the foot brush assembly of this invention may be manufactured, stored, transported, and sold in an orientation other than the position described.

A foot brush assembly 10 in accordance with the present invention is shown in FIGS. 1–7.

Referring to FIGS. 1–4, the foot brush assembly 10 is comprised of a basin or receptacle 20 including a bottom generally horizontal wall 22 (FIG. 4), a front wall 24 and a rear wall 26 extending generally vertically upwardly from and unitary with the front and rear peripheral edges respectively of the bottom wall 22, and opposing sidewalls 28 and 30 extending generally vertically upwardly from and unitary with the peripheral edge of the opposite sides respectively of the bottom wall 22. The rear wall 26 includes an elongate, generally rectangular lip 32 cut out of the top thereof.

A generally circular hook 33 extends unitarily outwardly from the outer surface of the front wall 24 of the basin 20 to allow the basin 20 to be hung and dried after use as will be described later.

Figure 7:
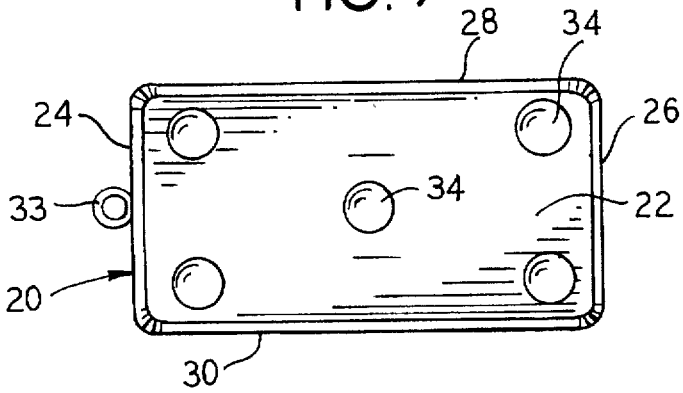
FIG. 7 is a reduced bottom plan view of the basin of the foot brush assembly shown in FIG. 1.

Referring to FIG. 7, a plurality of polymeric suction cups 34, each of somewhat bell shape, are attached by known means to the bottom surface of the bottom wall 22 to allow the releasable anchoring of the basin 20 to the floor of a tub, shower stall or the like. In the embodiment shown, the basin 20 includes four suction cups 34 disposed respectively at the four corners of the bottom of the basin 20 while a fifth suction cup 34 is positioned generally centrally on the bottom of the basin 20. It is understood, of course, that suction cups are simply exemplary of the various types of anchoring means which could be used to anchor the basin 20 to the floor of a shower stall or the like.

Basin 20 can be molded using a thermoplastic polymer and provided in a range of different colors to match various bathroom color schemes. Presently preferred polymers are low density polyethylene (LPD), very low density polyethylene (VLDPE), polypropylene (PP), and the like. All edges and surfaces of the basin 20 are generally rounded or curved to reduce the risk of injury during use.

The dimensions of the basin 20 and the foot brush assembly 10 can vary widely, but generally the foot brush assembly 10 will be designed so that it can be used on substantially all sizes of feet. Typically, the foot brush assembly 10 is approximately 11.5 inches (29.2 cm) long, 6.75 inches (17.1 cm) wide, and 3 inches (7.6 cm) high. The basin 20 is approximately 11.3 inches long (28.7 cm), 6.6 inches wide (16.8 cm), and 2 inches (5 cm) high.

Referring to FIGS. 1–5, the foot brush assembly 10 further comprises a base member 40 including an inclined top wall 42, a generally horizontal bottom wall 44, front and rear generally vertical walls 46 and 48 respectively extending between and unitary with the front and rear peripheral end edges of the top and bottom walls 42 and 44 respectively, and generally vertical sidewalls 50 and 52 extending between and unitary with the peripheral side edges of the top and bottom walls 42 and 44 respectively. A generally circular hook 53 extends unitarily outwardly from the outer surface of the front wall 46 to allow the base member 40 to be hung and dried after use.

Typically, the base member 40 is approximately 11.25 inches (28.5 cm) long and 5.75 inches (14.6 cm) wide. Typically, the front wall 46 has a height of about 1.25 inches (3.2 cm) and the rear wall 48 has a height of about 0.50 inches (1.3 cm) so that the top wall 42 is inclined at an angle of about 10 degrees with respect to the bottom wall 44.

Base member 40 is molded using the same thermoplastic polymer as basin 20. Moreover, all edges and surfaces of the base member 40 are generally rounded or curved to reduce the risk of injury during use.

The base member 40 further includes two spaced apart and co-linearly disposed male snap members 54 and 56 (FIG. 2) secured to each of the side walls 50 and 52 respectively. Snap members 54 and 56 are positioned on the sidewall 50 generally adjacent the front wall 46 of base member 40. Although not shown, snap members 54 and 56 are similarly positioned on sidewall 52.

Figure 3:
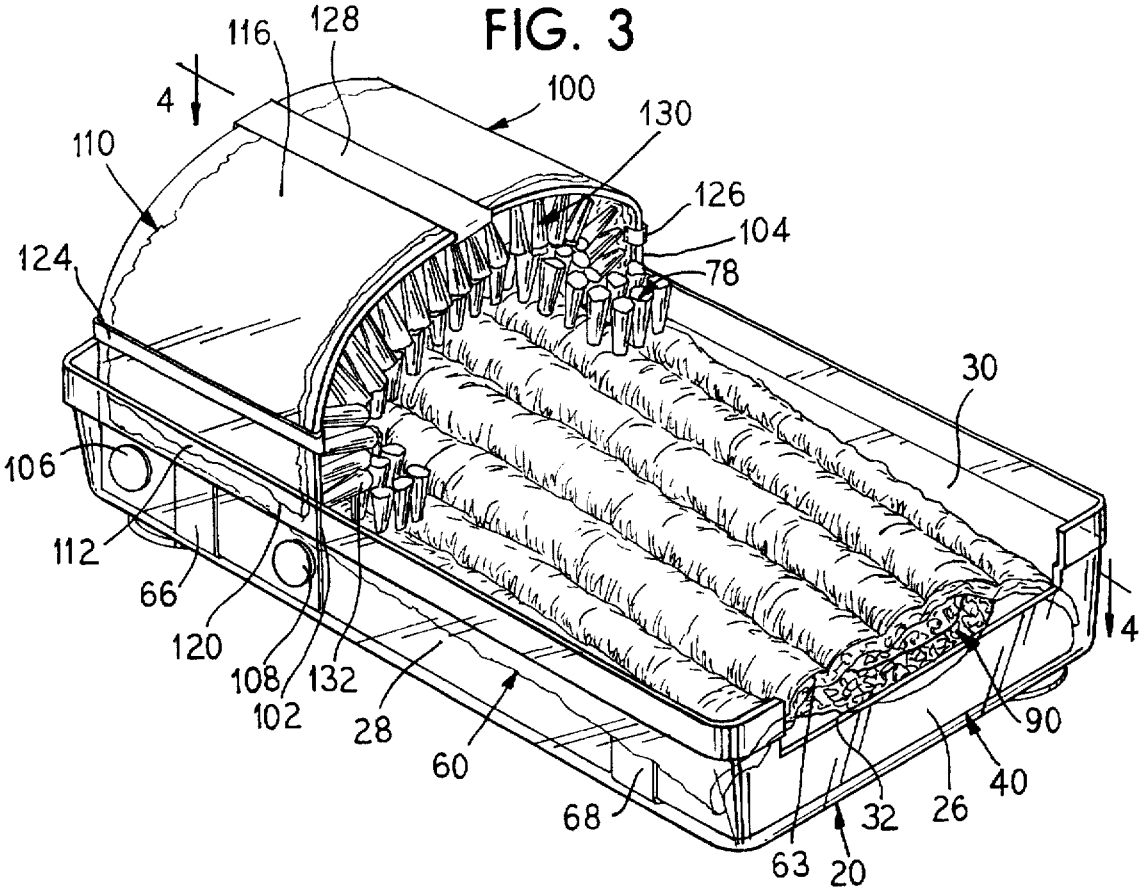
FIG. 3 is a perspective view of the foot brush assembly of FIG. 1 with the cover removed therefrom.
Figure 4:
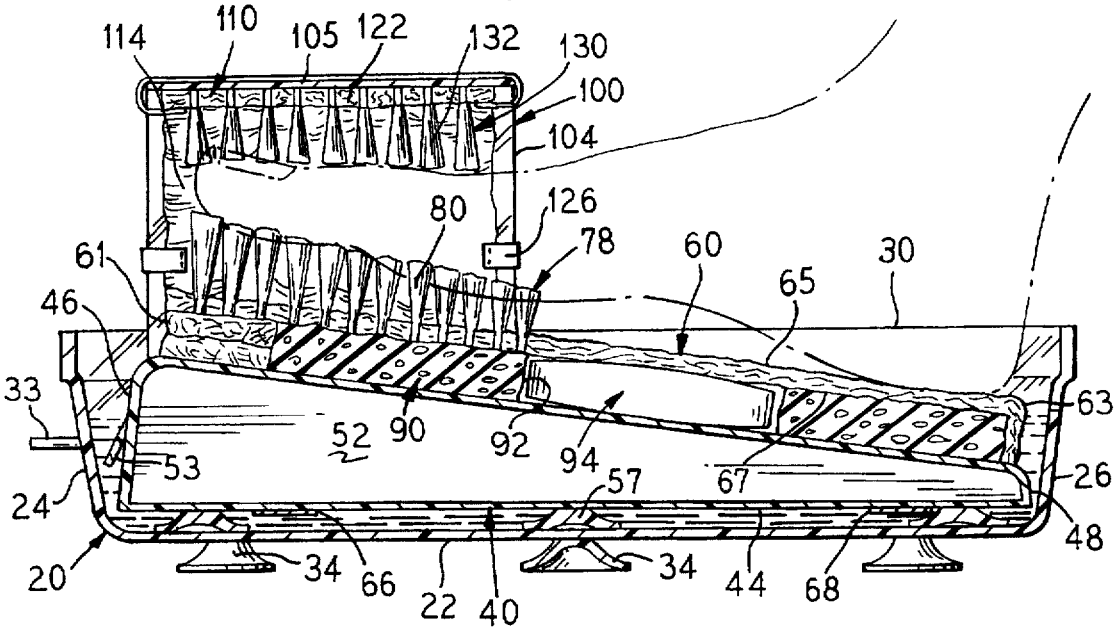
FIG. 4 is a vertical cross-sectional view of the foot brush assembly taken generally along the plane 4—4 in FIG. 3 with a foot shown therein in phantom.
Figure 6:
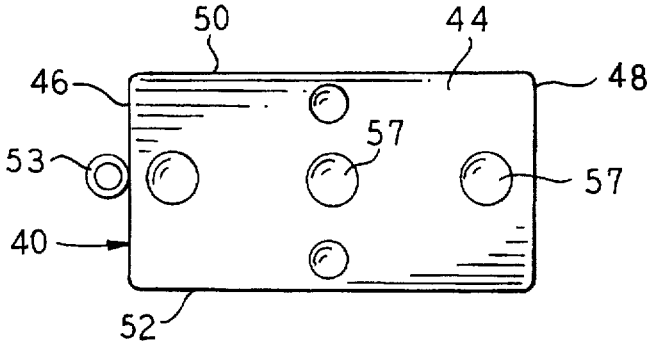
FIG. 6 is a reduced bottom plan view of the base member of FIG. 5.

Referring to FIG. 6, base member 40 includes a plurality of suction cups 57, each also of somewhat bell shape, attached by know means to the bottom surface 44 to allow the releasable anchoring of base member 40 inside the basin 20 as shown in FIGS. 3 and 4.

In the embodiment of FIG. 6, the base member 40 includes five suction cups 57 secured to the bottom of bottom wall 44 thereof. Three of the suction cups 57 have a diameter greater than the other two suction cups 57. The three suction cups 56 with a greater diameter extend co-linearly along the longitudinal axis of the base member 40 in spaced-apart relationship with one of the suction cups being disposed generally centrally on the bottom of the base member 40. The other two suction cups 57 are disposed on opposite sides of the centrally disposed suction cup 57 and adjacent the front and rear walls 46 and 48 respectively of the base member 40.

The two suction cups having a smaller diameter extend co-linearly along the transverse axis of the base member 40 and generally adjacent the sidewalls 50 and 52 on opposite sides of the centrally disposed suction cup 57 respectively. It is understood, of course, that suction cups are simply exemplary of the various known means which could be used to anchor the base member 40 inside the basin 20.

Figure 2:
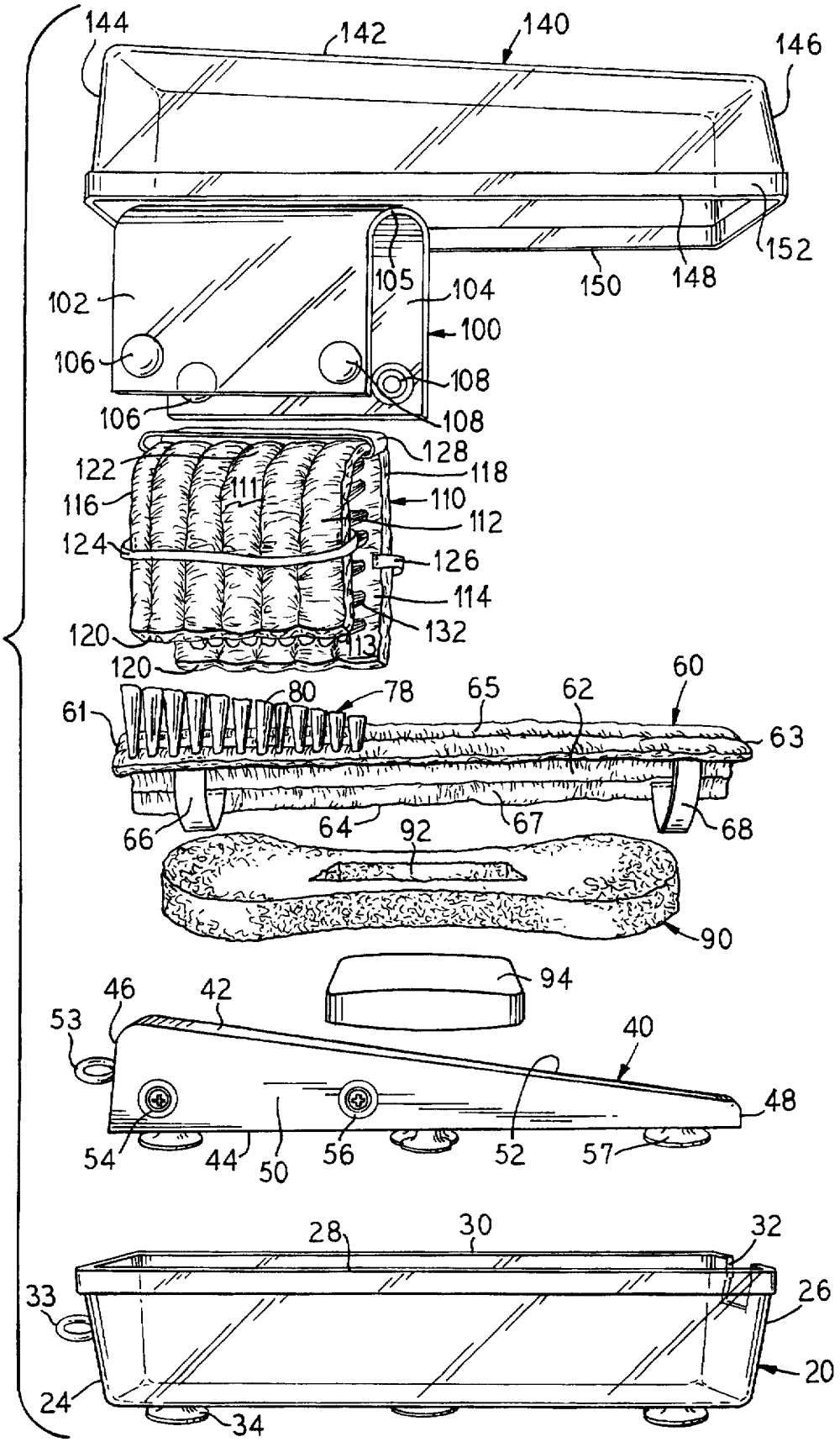
FIG. 2 is an exploded perspective view of the foot brush assembly of FIG. 1.
Figure 5:
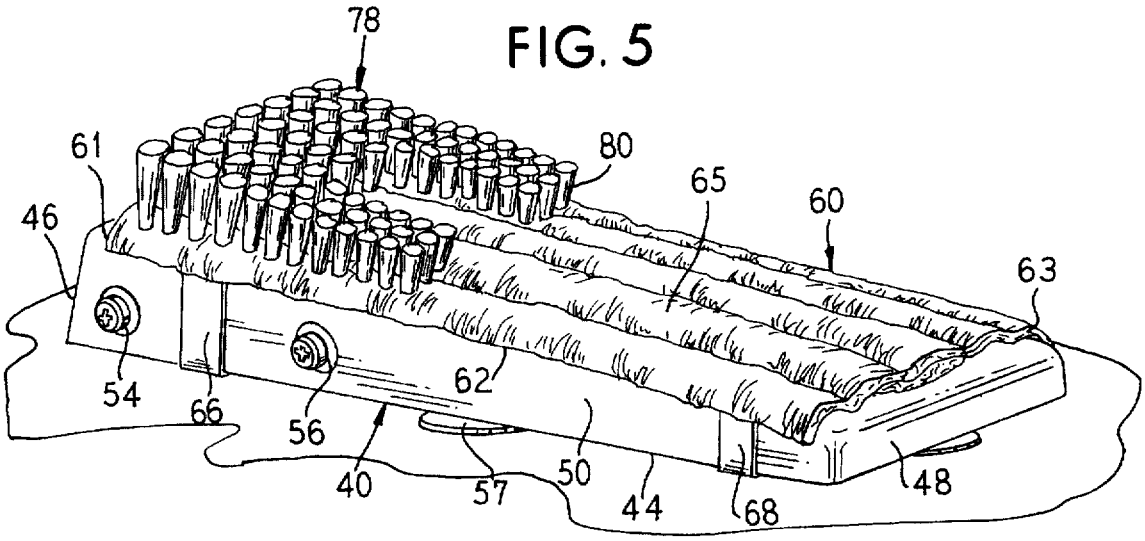
FIG. 5 is a perspective view of the base member of the foot brush assembly with a loofa base pad removably secured thereto.

Referring to FIGS. 2, 4 and 5, the foot brush assembly 10 further comprises a massaging and cleaning pad 60. The pad 60 is made of a sponge-like loofa plant fiber material which is used for massaging and cleaning and is made from a loofa plant which has been dried, has had the skin and seeds removed therefrom, and has had its fibers washed and dried. The result of this process is a massaging and cleaning pad 60 which is soft for use on the skin, releases soap at a desired rate and dries rapidly after use thus resisting mildew and the growth of other micro-organisms.

Although the use of a pad 60 made of a loofa material is preferred, it is understood that the material could be substituted with any other suitable massaging or cleaning material such as a cloth material.

As shown in FIG. 2, pad 60 is generally rectangularly shaped and is defined by a front peripheral edge 61, a rear peripheral edge 63, and opposite peripheral side edges 62 and 64. Pad 60 includes an upper surface 65 and a lower surface 67. Pad 60 has a length and width about equal to the length and width of the base member 40.

Pad 60 includes first and second elongate and generally wide straps 66 and 68 integral therewith which are preferably each made of a wide band of elastic material. Strap 66 extends along the width and lower surface 67 of the pad 60 adjacent to and parallel the front edge 61 of pad 60. Strap 68 extends along the width and lower surface 67 of the pad 60 adjacent to and parallel the rear edge 63 of pad 60.

One end of strap 66 is secured by stitching, gluing or other suitable method to the lower surface 67 of pad 60 adjacent the side edge 62 thereof while the opposite end of strap 66 is secured to the lower surface 67 of pad 60 adjacent the side edge 64 of pad 60.

Similarly, one end of strap 68 is secured by stitching, gluing or other suitable method to the lower surface 67 of pad 60 adjacent the side edge 62 of pad 60 while the opposite end of strap 68 is secured to the lower surface 67 of pad 60 adjacent the side edge 64 of pad 60.

Pad 60 further includes a generally U-shaped brush 78 (FIG. 5) for applying a massaging and scrubbing action to the toes and arch of a foot upon movement of the foot thereagainst as will be described later. Brush 78 comprises a plurality of filament tufts 80 which extend integrally upwardly from the upper surface 65 of the pad 60. Tufts 80 can be secured to the pad 60 by any suitable means including adhesive.

The diameter of the fibers used to form the filament tufts 80 of the brush 78 can vary widely but will generally be within from about 0.008 to about 0.025 inches (between about 0.020 cm and 0.063 cm) while the selection of the particular fiber will generally depend upon the degree of firmness desired to be imparted to the filament tufts 80. Polymers such as polyamide, polypropylene, polyethylene, co-polymers of polypropylene and ethylene, co-polymers of polypropylene and ethylene, polyflouride and the like can be used in the formation of the filament tufts 80.

In the embodiment shown in FIG. 5, the brush 78 includes a plurality of spaced-apart and parallel rows of tufts 80. The first row of tufts 80 extends along the width of the pad 60 adjacent to and parallel the front peripheral edge 61 of pad 60. The remaining rows extend rearwardly from the first row of tufts 80 in the direction of the rear peripheral edge 63 of pad 60 in spaced-apart and parallel relationship.

The height of each of the rows of filament tufts 80 decreases uniformly and gradually starting with the first row of tufts 80 and moving rearwardly towards the last row of tufts 80. Preferably, the tufts 80 decrease in height from a height of about 1.50 inches (3.8 cm) at the first row of filament tufts 80 to a height of about 1 inch (2.5 cm) at the last row of filament tufts 80. By providing a brush 78 of decreasing height, a massaging and scrubbing force is created in the area where the toes are joined to the foot.

The foot brush assembly 10 further comprises a sponge 90 (FIGS. 2 and 4) including a centrally disposed generally rectangularly shaped cavity 92 adapted and configured to receive a bar of soap 94. The term soap is used in a generic sense to include any type of solid detergent or cleaning material that is dissolved during use.

Referring to FIGS. 3 and 4, the sponge 90 is adapted to be placed between the base member 40 and the base pad 60. More particularly, sponge 90 is placed against the top surface 42 of the base member 40 and the bar of soap 94 is adapted to be placed into the cavity 92 of sponge 90 and against the top surface 42 of the base member 40.

The loofa base pad 60 is adapted to be removably secured to the base member 40 by stretching and wrapping the straps 66 and 68 of the pad 60 around, and into abutting relationship with, the sidewalls 50 and 52 and the bottom surface 44 of base member 40 such that the lower surface 67 of the pad 60 abuts the outer surface of the sponge 90 and the top surface 42 of the base member 40.

Referring to FIGS. 2–4, foot brush assembly 10 further comprises a generally U-shaped and arcuate bridge member 100 including two generally vertical, spaced-apart, parallel sidewalls 102 and 104 respectively and a generally arcuate top wall 106 extending between and unitary with the top peripheral edges of the sidewalls 102 and 104 respectively. Each of the sidewalls 102 and 104 includes first and second spaced-apart, co-linearly disposed, female snap members 106 and 108 respectively secured thereto adjacent the bottom peripheral edge of the sidewalls 102 and 104 respectively.

The bridge member 100 is molded using the same thermoplastic polymer as basin 20 and base member 40. Moreover, all edges and surfaces of the bridge member 100 are generally rounded or curved to reduce the risk of injury during use.

The foot brush assembly 10 further comprises a bridge member pad 110 which is also preferably made of the same type of loofa material as the base pad 60. Bridge member pad 110 is a generally rectangularly shaped pad which is folded into a U-shaped member as shown in FIG. 2. In its folded position, the bridge member pad 110 includes an outer surface 111 and an inner surface 113, opposite peripheral side edges 116 and 118, first and second generally vertically oriented, spaced-apart and parallel sidewalls 112 and 114, each including a bottom peripheral edge 120, and a top generally arcuate top wall 122 therebetween and unitary with the top peripheral transverse edges of the sidewalls 112 and 114 respectively.

Bridge member pad 110 additionally includes first and second elongate and generally wide straps 124 and 126 integral with the sidewalls 112 and 114 respectively and a third strap 128 integral with the top arcuate wall 116. Each of the straps 124, 126 and 128 is preferably made of an elongate and generally wide band of elastic material.

Strap 124 extends along the width of, and is centrally disposed over, the outer surface 111 of sidewall 112. One end of the strap 124 is secured by stitching, gluing or other suitable method to the inner surface 113 of the pad 110 adjacent the peripheral side edge 116 of sidewall 112 while the opposite end of strap 124 is secured to the inner surface 113 of pad 110 adjacent the peripheral side edge 118 of sidewall 114.

In a similar manner, strap 126 extends along the width of, and is centrally disposed over, the outer surface 111 of sidewall 114. One end of the strap 126 is secured to the inner surface 113 of the pad 110 adjacent the peripheral side edge 116 of pad 110 while the opposite end thereof is secured to the inner surface 113 of the pad 110 adjacent the peripheral side edge 118 of the pad 110. Straps 124 and 126 are co-planarly disposed with respect to each other.

Strap 128 extends along the width of, and is centrally disposed over, the outer surface 111 of the top wall 122. One end of strap 128 is secured to the inner surface 113 of pad 110 adjacent the peripheral side edge 116 of pad 110 while the other end thereof is secured to the inner surface 113 of pad 110 adjacent the peripheral side edge 118 thereof.

Referring to FIGS. 3 and 4, bridge pad 110 includes a brush 130 extending integrally outwardly from the inner surface 113 of pad 110 for applying a massaging and scrubbing action to the top and side surfaces of a foot upon movement of the foot thereagainst as will be described later. The brush 130, like the brush 78 of base pad 60, is comprised of a plurality of spaced-apart and parallel rows of filament tufts 132. The first row of filament tufts 132 is disposed adjacent to and extends along and parallel to the bottom peripheral edge 120 of the sidewall 112. The second and subsequent rows of filament tufts 132 are spaced from and parallel to the first row of filament tufts 132 and extend around the inner surface 113 of the U-shaped pad 110. The last row of filament tufts 132 extends adjacent to and along and parallel to the bottom peripheral edge 120 of the sidewall 114 (FIG. 2).

Each of the tufts 132 is secured into the pad 110 such that it extends perpendicularly outwardly from the inner surface 113 thereof. Preferably, each of the tufts 132 has a length of about 1 inch (2.5 cm) and the individual fibers thereof are made of the same polymeric material as the fibers of the filament tufts 80 of the brush 78 on base pad 60.

The loofa bridge pad 110 is adapted to be removably strappably secured to the bridge member 100. Initially, and although not shown, strap 128 is stretched and looped around the sidewall 112. The pad 110 is then inserted into the interior cavity of the bridge member 100 and the sidewalls 112 and 114 and the top wall 116 of the pad 110 are positioned into abutting relation with the sidewalls 102 and 104 and the top wall 106 respectively of bridge member 100 and the strap 128 is positioned centrally over and in abutting relation with the outer surface 111 of the top wall 116 of bridge member 110 as shown in FIG. 3. Straps 124 and 126 are then stretched and wrapped around the sidewalls 112 and 114 respectively and thereafter positioned centrally on, and in abutting relation with, the outer surface 111 of sidewalls 112 and 114 respectively, as shown in FIGS. 1 and 3 so as to secure the pad 110 to the bridge member 100.

Bridge pad member 100 is adapted to be releasably secured to the base member 40 as shown in FIGS. 3 and 4. Referring to FIGS. 2 and 3, sidewall 102 of bridge member 100 is secured to the sidewall 50 of the base member 40 by snapping the female snap members 106 and 108 in sidewall 102 of bridge member 100 into the mating male snap members 54 and 56 respectively in the sidewall 50 of the base member 40. In a like fashion, and although not shown, the sidewall 104 of bridge member 100 is releasably secured to the sidewall 52 of the base member 40 by snapping the female snap members 106 and 108 respectively in the sidewall 104 of bridge member 100 into the mating male snap members 54 and 56 respectively in the sidewall 52 of the base member 40.

Although the embodiment shown discloses the use of mating snap members to releasably secure the bridge member 100 to the base member 40, it is understood that the invention encompasses any other suitable known means for effecting such releasable securement such as a hoop and loop type securement means.

In its releasably secured position, the bridge member 100 is positioned such that the peripheral end edges of the tufts 132 of brush 130 on the bridge pad 110 oppose the peripheral end edges of the tufts 80 of the brush 78 on base pad 60. More particularly, the brushes 78 and 130 are so situated with respect to each other such that the toes of a foot naturally extend into a cavity formed between the peripheral end edges of the respective brushes 78 and 130 without an unnatural deflection of the toes as best seen in FIG. 4.

Referring to FIGS. 1 and 2, the foot brush assembly 10 further comprises a cover 140 including a top surface 142, a front wall 144 and a rear wall 146 extending unitarily generally downwardly from the peripheral front and rear edges respectively of the top surface 142, and sidewalls 148 and 150 extending generally downwardly from and unitary with the peripheral side edges of the top surface 142. The cover 140 additionally includes a shoulder 152 extending circumferentially along and adjacent the lower edge of the walls of the cover 140. As shown in FIG. 1, the cover 140 is adapted to fit over the basin 20 with the shoulder 152 seated against the top edge of the walls of the basin 20. The cover 140 may be placed over the foot brush assembly 10 when it is not in use. Alternatively, the cover 40 may be used as a foot rinse basin as described later.

The cover 140 is also molded using the same thermoplastic polymer as the basin 20, the base member 40 and the bridge member 100. Moreover, all edges and surfaces of the cover 140 are generally rounded or curved to reduce the risk of injury during use.

The foot brush assembly 10 of the present invention is advantageously utilized in a shower and is placed on the floor of the shower basin. According to the invention, the foot brush assembly 10 can be used in the shower in either the FIG. 3 embodiment or the FIG. 5 embodiment.

In the FIG. 3 embodiment, the foot brush assembly 10 includes the basin 20 with the base member 40 seated in the interior of basin 20 and the bridge member 100 removably secured to the base member 40. The basin 20 is secured to the shower floor via suction cups 34 on the bottom surface thereof. When used as shown in FIG. 3, the basin 20 may be filled with water to a level where a portion of the base member 40, sponge 90, soap 94 and base pad 60 are covered with water. The foot to be massaged or cleaned is positioned on top of the base pad 60 substantially as shown in FIG. 4 with the toes and instep of the foot fitted within the cavity between the brushes 78 and 130 of the base pad 60 and the bridge pad 110 respectively. In this position, the tufts 80 of brush 78 abut the bottom of the toes, the ball of the foot, and the arch of the foot and the tufts 132 of brush 130 abut the top and sides of the toes and the top and sides of the instep of the foot. The heel of the foot is seated on and abuts the rear of the base pad 60.

The foot is then moved in a fore and aft direction to effect a thorough massaging and cleaning action. More particularly, the fore and aft movement of the foot against the top surface 65 of the base pad 60 causes the massaging and cleaning of the heel and arch portions of the foot. Moreover, the fore and aft movement of the foot causes the base pad 60 to contact the bar of soap 94 to create a soap lather which travels through the base pad 60 and onto the foot. The wide fiber structure of the loofa material allows the free movement of the soap lather through the base pad 60. Further, the fore and aft movement of the foot within the cavity defined by brushes 78 and 130 of the base pad 60 and the bridge pad 110 respectively causes the brush 78 on base pad 60 to cleanse the bottom of the toes, and the ball of the foot. Still further, the fore and aft movement of the foot causes the brush 130 on bridge pad 110 to cleanse the top and sides of the toes, and the top and sides of the foot instep. The fore and aft movement of the foot within the basin 20 is accommodated by the lip 32 in the rear wall 26 of the basin 20.

The suction cups 57 on the bottom of the base member 40 prevent the base member 40 from slipping in the basin 20 during the fore and aft movement of the foot on top of the base member 40. When use has been completed, the basin 20 may be hung by its hook 33 to allow the same to drip dry.

The basin 20 allows the FIG. 3 foot brush assembly embodiment to be used outside the shower either as a foot cleaning assembly or a foot massaging assembly with or without water in the basin 20 and with or without the soap 94. Where the assembly 10 is used as a foot cleaning assembly outside the shower, the cover 140 can be filled with water and used as a foot rinse basin.

Alternatively, the foot brush assembly 10 can be used in a shower or the like in the embodiment as shown in FIG. 5 where the base member 40 is secured to the floor of the shower basin and is used in a similar fashion as the FIG. 3 embodiment but without either the basin 20 or the bridge member 100. When used as depicted in FIG. 5, the lather would be produced by the water flowing down from the shower head into contact with the base pad 60 during use. When use has been completed, the base member 40 may be hung by its hook 53 to allow the same to drip dry.

To speed the drying process after use and to minimize the growth of mildew or other micro-organisms, the bridge pad 110 can advantageously be removed from the bridge member 100 and the base pad 60 and sponge 90 can advantageously be removed from the base member 40. The use of a loofa material speeds the drying process. The removability feature also allows the base pad 60 and bridge pad 100 to be washed or replaced.

The foot brush assembly 10 of the present invention thus provides a compact, self-contained foot brush assembly which can readily and easily be used to thoroughly cleanse and/or massage the feet without needing to bend over or lift the foot. The multi-component structure of the foot brush assembly 10 allows the assembly 10 to be used in or outside the shower. The multi-component structure also allows for the removal, washing, or replacement of the cleansing pads. The use of pads made of a loofa material improves the cleansing process and helps to speed the drying process thus eliminating the growth of mildew or other micro-organisms.

What is claimed is:

1. A foot brush assembly comprising:

a base member;

a base pad disposed over said base member, a user's foot being placed on and rubbed against the top of said base pad to massage or clean the bottom of the foot; and base pad strap means on said base pad which extend around said base member for removably securing said base pad to said base member.

2. The foot brush assembly of claim 1 wherein said base member includes opposed side walls and a bottom wall, said base pad including opposite side edges, said base pad strap means comprising an elastic base pad strap with opposite ends, one of the ends of said base pad strap being secured to one of the side edges of said base pad and the other end of said base pad strap being secured to the opposite side edge of said base pad, said base pad strap extending around and abutting said side walls and said bottom wall of said base member to removably secure said base pad to said base member.

3. The foot brush assembly of claim 1 wherein said base member includes opposed side walls and a bottom wall, said base pad including opposed elongate front and rear edges and opposed elongate side edges, said base pad strap means comprising first and second elastic base pad straps extending below said base pad and adjacent to and parallel the front and rear elongate edges of said base pad respectively, each of said first and second base pad straps including opposite ends wherein one end is connected to one side edge of said base pad and the other end is connected to the opposite side edge of said base pad, each of said first and second base pad straps extending around and abutting said side walls and said bottom wall of said base member to removably secure said base pad to said base member.

4. The foot brush assembly of claim 1 wherein said base member includes a front wall and a rear wall, the foot brush assembly further comprising:

a bridge member removably secured over the top of said base member adjacent the front wall of said base member to define a foot receiving cavity, said bridge member including an outer surface and an inner surface;

a bridge pad disposed over the inner surface of said bridge member so that when the foot is inserted in said cavity, the top of the foot can be massaged or cleaned by brushing the top of the foot against the bridge pad; and bridge pad strap means on said bridge pad for removably securing said bridge pad to the inner surface of said bridge member.

5. The foot brush assembly of claim 4 wherein said bridge pad includes opposite elongate side edges, said bridge pad strap means comprising an elongate elastic bridge pad strap extending over said bridge pad, said bridge pad strap including opposite ends, one of the ends of said bridge pad strap being secured to one side edge of said bridge pad and the other end of said bridge pad strap being secured to the opposite side edge of said bridge pad, said bridge pad strap extending around and abutting said outer surface of said bridge member to removably secure said bridge pad to the inner surface of said bridge member.

6. The foot brush assembly of claim 4 wherein said base member includes opposed side walls, said bridge member including opposite ends removably secured to said opposed side walls of said base member respectively, said bridge pad including opposed elongate end edges and opposed elongate side edges, said bridge pad strap means comprising first, second and third elastic bridge pad straps extending above said bridge pad, said first and second bridge pad straps being disposed adjacent and parallel the opposed end edges of said bridge pad respectively and said third bridge pad strap being disposed therebetween, each of said first, second and third bridge pad straps including opposite ends secured to said opposed side edges of said bridge pad respectively, each of said first, second, and third bridge pad straps extending around and abutting said outer surface of said bridge member to removably secure said bridge pad to said bridge member.

7. A foot brush assembly comprising:

a base member;

a loofa base pad disposed over said base member, a user's foot being placed on top of said loofa base pad so that the bottom of the foot can be massaged or cleaned by brushing the bottom of the foot against the loofa base pad; and a base pad brush on said loofa base pad extending generally upwardly away from said loofa base pad, the bottom of the foot being massaged or cleaned by brushing the bottom of the foot against said base pad brush; and base pad strap means on said loofa base pad for removably securing said loofa base pad to said base member.

8. The foot brush assembly of claim 7 wherein said base member includes a front wall and a rear wall, said foot brush assembly further comprising:

a bridge member removably secured over the top of said base member adjacent the front wall thereof to define a foot receiving cavity, said bridge member including an inner surface;

a loofa bridge pad disposed over the inner surface of said bridge member so that the top of the foot can be massaged or cleaned by brushing the top of the foot against the loofa bridge pad when the foot is received in said cavity; and bridge pad strap means for securing said loofa bridge pad to said inner surface of said bridge member.

9. The foot brush assembly of claim 8 wherein said loofa bridge pad includes a bridge pad brush extending away from said bridge pad, the top and sides of the foot being massaged or cleaned by brushing the top and sides of the foot against said bridge pad brush.

10. A foot brush assembly comprising:

a base member including top and bottom walls, opposed sidewalls and front and rear walls;

a loofa base pad disposed over said top wall of said base member, said loofa base pad including a front edge and rear edge, the bottom of the foot being rubbed against said loofa base pad;

a brush on said loofa base pad adjacent the front edge thereof, said brush including a plurality of bristles extending generally upwardly away from said loofa base pad, the toes and bottom of the foot being rubbed against the bristles;

first and second spaced apart elastic base pad straps on said loofa base pad for removably securing said loofa base pad to said base member, said first and second base pad straps extending around and abutting said sidewalls and said lower wall of said base member;

a sponge disposed between said base member and said loofa base pad, the sponge including a cavity therein adapted to receive a bar of soap;

a bridge member removably secured over the top of said base member and positioned adjacent the front wall of said base member to define a foot receiving cavity between said bridge member and said base member, said bridge member including an inner and outer surface opposed side walls and a top wall therebetween, said opposed sidewalls of said bridge member being removably secured to said sidewalls of said base member respectively;

a loofa bridge pad removably secured to the inner surface of said bridge member;

a brush on said bridge pad including a plurality of bristles extending the length of, and generally perpendicularly away from, said loofa bridge pad, the top and sides of the toes and the foot being rubbed against said brush when the foot is placed inside said cavity defined by said bridge member; and a plurality of elastic bridge pad straps on said loofa bridge pad for removably securing said loofa bridge pad to said bridge member, said bridge pad straps extending around and abutting said outer surface of said bridge member.

11. The foot brush assembly of claim 10 further comprising a basin including a bottom surface, front and rear walls and opposing sidewalls extending generally upwardly from the periphery of said bottom surface, the base member being received within said basin.

12. The foot brush assembly of claim 11 further including suction cups on the bottom surface of said basin for releasably securing said basin to a support surface.

13. The foot brush assembly of claim 11 further including suction cups on the bottom of said base member for releasably securing said base member within said basin.

14. The foot brush assembly of claim 11 further comprising a cover adapted to be fitted over said basin and said base member.

15. The foot brush assembly of claim 10 wherein said upper surface of said base member is disposed at an inclined angle.

16. The foot brush assembly of claim 10 further comprising cooperating snap means on said sidewalls of said bridge member and said sidewalls of said base member respectively for removably securing said bridge member to said base member.

17. The foot brush assembly of claim 10 wherein said plurality of bristles on said loofa base pad are disposed at an inclined angle and in a generally U-shaped configuration.

18. The foot brush assembly of claim 10 wherein said base pad includes opposed elongate front and rear edges and opposed elongate side edges, said first and second elastic base pad straps extending below said base pad and adjacent to and parallel the front and rear elongate edges of said base pad respectively, each of said first and second base pad straps including opposite ends wherein one end is connected to one side edge of said base pad and the other end is connected to the opposite side edge of said base pad, each of said first and second base pad straps extending around and abutting said side walls and said bottom wall of said base member to removably secure said base pad to said base member.

19. The foot brush assembly of claim 10 wherein said bridge pad includes opposed elongate end edges and opposed elongate side edges, said bridge pad including first, second and third elastic bridge pad straps extending above said bridge pad, said first and second bridge pad straps being disposed adjacent and parallel the opposed end edges of said bridge pad respectively and said third bridge pad strap being disposed therebetween, each of said first, second and third bridge pad straps including opposite ends secured to said opposed side edges of said bridge pad respectively, each of said first, second, and third bridge pad straps extending around and abutting said outer surface of said bridge member to removably secure said bridge pad to said bridge member.

* * * * *

UNITED STATES PATENT AND TRADEMARK OFFICE

CERTIFICATE OF CORRECTION

PATENT NO. : 5,724,695
DATED : Mar. 10, 1998
INVENTOR(S) : Galizia

It is certified that error appears in the above-identified patent and that said Letters Patent is hereby corrected as shown below:

col. 5, line 43, delete "106" and insert -- 105 --.

col. 6, line 5, delete "116" and insert -- 122 --.

col. 6, line 57, delete "116" and insert -- 122 --.

col. 6, line 59, delete "106" and insert -- 105 --.

col. 6, line 61, delete "116" and insert -- 122 --.

Signed and Sealed this

Twenty-sixth Day of January, 1999

*Attest:*

*Attesting Officer*

*Acting Commissioner of Patents and Trademarks*